United States Patent [19]

Jensen

[11] 4,007,879

[45] Feb. 15, 1977

[54] TEXTURE APPLICATOR

[76] Inventor: Elvin R. Jensen, 953 E. Howard, Pasadena, Calif. 91104

[22] Filed: Nov. 5, 1975

[21] Appl. No.: 628,986

[52] U.S. Cl. ..... 239/214; 239/229; 239/374

[51] Int. Cl.[2] ..... B05B 3/00

[58] Field of Search ..... 239/652, 214, 229, 302, 239/320, 324, 374, 219, 220, 221, 546, 602; 222/406, 407; 401/28, 115; 124/5

[56] References Cited

UNITED STATES PATENTS

| | | | |
|---|---|---|---|
| 671,047 | 4/1901 | Fox | 401/28 |
| 982,661 | 1/1911 | Dickens | 239/320 X |
| 1,191,120 | 7/1916 | Andacht | 239/374 |
| 2,162,907 | 6/1939 | Bambach | 401/28 |
| 2,865,325 | 12/1958 | Leston et al. | 239/220 X |

*Primary Examiner*—John J. Love
*Attorney, Agent, or Firm*—Fulwider, Patton, Rieber, Lee & Utecht

[57] ABSTRACT

There is disclosed a texture applicator including a tubular handle formed with an elongated chamber for receipt of flowable texture material and mounting on one end thereof a plurality of hollow, open-ended flex members projecting therefrom with the projecting extremities of such tubes forming flexible hollow whip tubes for passage therethrough of the flowable texture material. A removable closure is mounted on the opposite end of such handle and may be in the form of a plunger to force the flowable texture material into the hollow whip tube.

9 Claims, 5 Drawing Figures

3
4
11
13
15
17
19
21
23
27
29
31
33

TEXTURE APPLICATOR

BACKGROUND OF THE INVENTION

1. Field of the Invention:

The texture applicator of the present invention relates to a device for applying plaster-like texture material to drywall such as an interior ceiling wall.

2. Description of the Prior Art:

Conventional texture applicators are in the form of pressurized systems requiring a compressor or the like to pressurize a texture gun which receives flowable plasterlike texture material and releases it through an orifice to spray it evenly on the area to be textured to form rough noise-dispersing droplets defining bumps and rises applied uniformly over the entire textured surface to give an eyeappealing appearance. However, when certain small areas of such textured surface are damaged or the texture material otherwise removed therefrom, thus necessitating repair, it is frequently inconvenient and expensive to employ conventional pressurized flex texture applicator guns. Further, application of the texture material manually frequently provides a relatively uneven surface failing to have continuity with the surrounding area, thereby failing to provide the desired eye appeal. Applicant is unaware of any texture applicator which is inexpensive to manufacture and can be conveniently utilized by a relatively unskilled workman in applying texture material over a small area to rapidly and effectively repair such small area and provide a repaired surface which is essentially undetectable when compared with the surrounding texture material applied by a pressurized gun.

SUMMARY OF THE INVENTION

The texture applicator of the present invention is characterized by a hollow, tubular handle receiving flowable, plaster-like texture material therein and having hollow, open-ended flex members projecting from one end thereof with the projecting free extremities of such members being flexible to define whip tubes that may have their ends flexed to one side and will whip back past their normal position to whip such texture material from the open ends of such tubes.

The objects and advantages of the present invention will become apparent when taken in consideration with the following detailed description of the drawing.

DESCRIPTION OF THE PREFERRED EMBODIMENT

Figures 1, 2, 3, 4, 5:
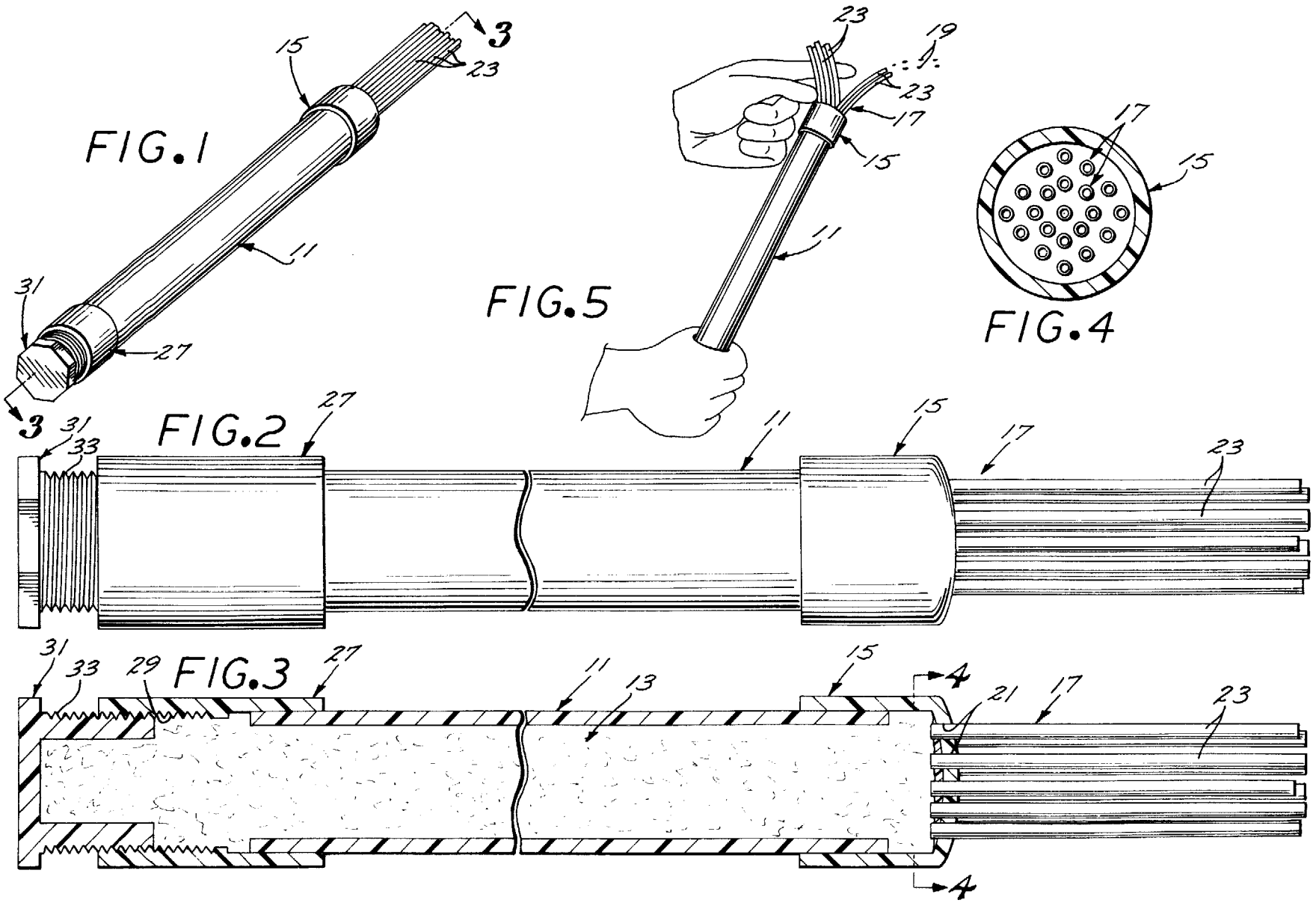
FIG. 1 is a perspective view of a texture applicator embodying the present invention.
FIG. 2 is a broken side view, in enlarged scale, of the texture applicator shown in FIG. 1.
FIG. 3 is a broken, longitudinal sectional view, taken along the line 3—3 of FIG. 1.
FIG. 4 is a transverse, sectional view, taken along the line 4—4 of FIG. 3.
FIG. 5 is a perspective view, in reduced scale, showing the texture applicator of FIG. 1 in use.

The texture applicator of the present invention includes, generally, a hollow handle 11 formed centrally with a chamber 13 (FIG. 3) for receipt of flowable texture material. Mounted on one end of the handle 11 is a whip tube cap, generally designated 15, having a plurality of hollow, open-ended flex members 17 projecting co-extensively therefrom to have the free extremities define whip tubes 23. The whip tubes 23 themselves may have their projecting extremities drawn to one side, as shown in FIG. 5, and released to snap to the opposite side as designated by the numeral 23', thus propelling relatively uniform-sized droplets 19 of flowable texture material therefrom for uniform application to a surface being repaired.

The handle 11 may be constructed of cylindrical tubular plastic and the cap 15 is also of plastic and is cup-shaped to be received telescopically over one extremity of the handle 11. The end wall of the cap 15 is formed with a plurality of through bores 21 having one extremity of the flex members 17 projected thereinto and bonded in place. The flex members 17 themselves may be of relatively stiff plastic tubing having an inner diameter of 3/16 inch and project approximately 3 inches from the cap 15 to form the springy whip tubes 23 which are open-ended for release therefrom of the texture material droplets 19. Such whip tubes 23 should be at least 2 inches long to obtain the necessary whip action and in the preferred embodiment, they are cut to different lengths to thus terminate on their free ends in different planes so droplets 19 (FIG. 5) propelled from different ones of such tubes will be propelled from a different plane to be impinged at different points on the receiving surface.

Received telescopically over the opposite end of such handle 11 is a tubular coupling, generally designated 27, which is bonded to the handle itself and has its extremity formed with internal threads 29 which mate with exterior threads 31 formed in the exterior wall of a plug, generally designated 33. The plug itself is also cup-shaped and screws telescopically into the coupling 27 to force the texture material through the handle 11 and into the projecting whip tubes 23.

In operation, the texture applicator of the present invention may be conveniently utilized to cover a repaired area on a textured surface from which the texture material itself has been removed and can be conveniently utilized by merely removing the plug 33 and filling the chamber 13 with a flowable paste-like texture material and then screwing the plug 33 back into place. The plug 33 is screwed sufficiently far into the coupling 27 to press the texture material through the handle 11 and into the flex members 17 to fill the whip tubes 23 throughout their length with an initial charge of texture-like material. The handle 11 may then be grasped with one hand, as shown in FIG. 5, and the other hand used to draw the ship tubes 23 to one side, as shown in FIG. 5, and the whip tubes then released to allow them to snap back to their normal position and beyond such normal position as represented by the tubes 23' to propel the droplets 19 from the open ends thereof. The handle 11 may then be shaken to bring the whip end rapidly downwardly to an abrupt stop to thrust a further charge of texture material into the whip tubes 23 under its own momentum for subsequent snapping onto the surface to be repaired. This process may be repeated to cover the entire damaged area to the thickness and density required to match the surrounding area. It has been found that the particular construction shown provides for release of relatively uniform droplets of texture material and that the droplets released are applied to the repair surface in a relatively uniform manner.

From the foregoing, it will be apparent that the texture applicator of the present invention provides an economical and effective means for repairing a textured surface without the necessity of bringing elaborate, expensive equipment to the work location, thus making the overall repair job much more convenient and less expensive.

Various modifications and changes may be made with regard to the foregoing detailed description without departing from the spirit of the invention.

I claim:

1. A texture applicator for applying a flowable texture material and comprising:

a tubular handle formed with an elongated chamber for receipt of said flowable texture material and defining first and second ends;

an end wall on said first end;

hollow, open-ended flex members projecting on their respective one ends through said end wall and projecting coextensively from said handle to define whip tubes; and a removable closure mounted on said handle and normally closing said second end whereby said closure may be removed, said flowable texture material inserted in said tubular handle, said closure replaced and said applicator manipulated about to pivot said one end rapidly downwardly to an abrupt stop to force said material under its own momentum in small flow streams into the free extremities of said whip tubes so said whip tubes may be drawn to one side from their normal position and released to snap back past their normal position to whip said flex material from said flow streams in separated droplets to be applied in a random pattern to a surface to be textured.

2. A texture applicator as set forth in claim 1 wherein:

said second end of said handle is internally threaded; and said closure includes externally threaded plug means screwed into said second end.

3. A texture applicator as set forth in claim 1 wherein:

said whip tubes are formed with an internal diameter of at least 1/16 of an inch.

4. A texture applicator as set forth in claim 1 wherein:

said whip tubes are at least 3 inches long.

5. A texture applicator as set forth in claim 1 wherein:

said whip tubes terminate at their projecting extremities in different planes.

6. A texture applicator as set forth in claim 1 wherein:

said whip tubes are at least 2 inches long.

7. A texture applicator as set forth in claim 2 wherein:

said whip tubes are at least 3 inches long.

8. A texture applicator as set forth in claim 2 wherein:

said whip tubes terminate at their projecting extermities in different planes.

9. A texture applicator as set forth in claim 4 wherein:

said whip tubes terminate at their projecting extremities in different planes.

* * * * *